United States Patent [19]

Bohrn et al.

[11] 4,222,740

[45] Sep. 16, 1980

[54] COLORATION METHOD FOR TEXTILES

[75] Inventors: Walter J. Bohrn; William A. Moggio, both of Lancaster, Pa.

[73] Assignee: Armstrong Cork Company, Lancaster, Pa.

[21] Appl. No.: 17,181

[22] Filed: Mar. 5, 1979

[51] Int. Cl.[2] ..... D06P 5/12; D06P 5/15

[52] U.S. Cl. ..... 8/448; 8/526

[58] Field of Search ..... 8/1 R, 1 XB, 65, 66, 8/79, 14, 18 R

[56] References Cited

U.S. PATENT DOCUMENTS

| | | | |
|---|---|---|---|
| 3,743,477 | 7/1973 | Egli et al. | 8/66 |
| 3,909,191 | 9/1975 | McCoy | 8/18 R |

*Primary Examiner*—John Kight, III

*Attorney, Agent, or Firm*—Dennis M. Kozak

[57] ABSTRACT

A coloration method for textiles using chemically formed gels is disclosed. The method provides considerable freedom for making color designs and precise pattern prints, and can be used with conventional dyeing and printing equipment. In one embodiment of this invention, gelled regions are formed by separately applying a gelable composition containing alginic acid or an alginic acid derivative and a gelling agent composition to a textile material, and then over-dyeing the material, the gelled regions serving as dye resist regions. In another embodiment of this invention, lateral ink spread typically occurring as a result of printing or imparting patterning to the textile material is reduced by incorporating a dye into either the gelable composition, the gelling agent composition or both compositions, such that when one of the compositions is applied over the other composition, gelled print or pattern regions are formed, lateral spreading of the compositions is inhibited and, accordingly, excellent print or pattern definition is achieved.

11 Claims, No Drawings

COLORATION METHOD FOR TEXTILES

This invention relates to textiles.

More specifically, this invention relates to a coloration method for textiles.

In one of its more specific aspects, this invention pertains to a coloration method for textiles using chemically formed algin gels.

As used herein, the term "textiles" is understood to mean (1) flat or cloth fabric in woven or non-woven form and (2) pile fabric such as upholstery fabric and pile carpeting, produced using any conventional type of semisynthetic, synthetic or natural fiber.

Methods for coloring textiles are well known in the art and include: The use of dye rate controlling agents which either increase or decrease the rate of dyeing as taught in U.S. Pat. No. 3,669,661, and the use of dye splattering techniques, sometimes called Tak dyeing, as taught in U.S. Pat. No. 4,010,709. Also well known in the art is the use of print paste thickeners to give the desired degree of viscosity to print paste. For example, see "Printing Thickeners: Their Properties and Uses" by N. C. Shah, published in the May, 1969, issue of Silk and Rayon Industries of India, pages 265–286.

The present invention provides yet another method for imparting color to textiles, which method provides considerable freedom for making color designs and precise pattern prints. This method can be carried out using conventional dyeing and printing equipment.

In one embodiment, gelled regions are formed by separately applying a gelable composition and a gelling agent composition to a textile material. The material is then over-dyed, the gelled regions serving as dye resist regions.

In another embodiment, lateral ink spread typically occurring as a result of printing the textile material is reduced by incorporating a dye into either the gelable composition, the gelling agent composition or both compositions, such that when one of the compositions is applied over the other composition, gelled pattern or print regions are formed, lateral spreading of the compositions is inhibited and, accordingly, excellent print or pattern definition is achieved.

According to this invention, there is provided a coloration method for textiles, which method comprises:

(a) applying to at least a portion of the surface of a textile material a first aqueous composition;

(b) applying over at least a portion of said first aqueous composition a second aqueous composition, one aqueous composition being a chemically gelable composition containing alginic acid or an alginic acid derivative, the other aqueous composition being a gelling agent for the gelable composition; whereby the first and the second aqueous compositions undergo chemical reaction and gel in regions in which they are in contact and form gelled regions on the textile material, which gelled regions are thermally irreversible within the temperature range of from ambient temperature up to about 300° F. and water insoluble;

(c) dyeing the resulting textile material, the gelled regions serving as dye resist regions;

(d) fixing the dye on the textile material, during which fixing operation the gelled regions remain gelled; and (e) removing the gel from the textile material.

Also according to this invention, there is provided a method of printing or imparting patterning to textile material in which lateral ink spread on the textile material is reduced, which comprises:

(a) applying to at least a portion of the surface of a textile material a first aqueous composition;

(b) applying over at least a portion of said first aqueous composition a second aqueous composition, one aqueous composition being a chemically gelable composition containing alginic acid or an alginic acid derivative, the other aqueous composition being a gelling agent for the gelable composition, at least one of the gelable composition or the gelling agent composition containing a dye; whereby the first and the second aqueous compositions undergo chemical reaction and gel in the regions in which they are in contact and form gelled print or pattern regions on the textile material which gelled regions are thermally irreversible within the temperature range of from ambient temperature up to about 300° F. and water insoluble;

(c) fixing the dye contained in said at least one of the compositions on the textile material, during which fixing operation the gelled regions remain gelled; and (d) removing the gel from the textile material.

As used herein, the aqueous composition containing alginic acid or an alginic acid derivative will be referred to as the "gelable composition," and the aqueous composition for gelling the gelable composition will be referred to as the "gelling agent composition."

As used herein, the term "dye" is understood to mean and include acid dyes, algin compatible cationic dyes, algin incompatible cationic dyes (discussed below), direct dyes and disperse dyes. Acid dyes are typically employed to impart color to nylon textiles. Cationic dyes are typically employed to impart color to acrylic textiles. And, disperse dyes are typically employed to impart color to polyester as well as nylon textiles.

As used herein, the term "ambient temperature" is understood to mean room temperature, that is, an interior temperature of from about 68° to about 77° F.

As used hereinafter, the term "dye modifying agent" is understood to mean any material which serves to modify the dye shade applied using a first aqueous composition which contains a dye. For example, if the first aqueous composition contains a blue dye, applying a second aqueous composition containing a dye modifying agent (e.g., "Alkanol NRT," a dye displacement chemical commercially available from DuPont de Nemours E.I., Co.) over the first aqueous composition will result in a lighter blue dye shade.

Any suitable dye modifying agent can be employed. Suitable dye modifying agents include conventional pH modifiers such as soda ash, conventional dye assists such as benzyl alcohol, colorless fiber reactive dyes such as "Sandospace S," commercially available from Sandoz Colors and Chemicals, and conventional dye displacement chemicals such as "Alkanol NRT." The dye modifying agents are employed in art recognized amounts.

As used herein the term "lateral ink spread" is understood to mean the migration of dye or dye modifying agent laterally on a textile material resulting in a dyed or dye modified area which is wider than the desired width, for example, wider than the width that a printing screen is designed to provide.

In one embodiment of this invention, the first aqueous composition is the gelable composition, and the second aqueous composition is the gelling agent composition.

In another embodiment, the first aqueous composition is the gelling agent composition, and the second aqueous composition is the gelable composition.

In another embodiment, either the gelable composition, the gelling agent composition, or both compositions contain at least one dye.

In another embodiment, the textile material may be conventionally background dyed prior to step (a).

In yet another embodiment, to facilitate gelation, the gelling agent composition can be applied twice, for example, if the gelling agent composition is applied first and the gelable composition superimposed thereover, the gelling agent composition can be separately applied a second time over the gelable composition. The two separate applications of the gelling agent composition serve to increase the area of contact between the gelable composition and the gelling agent composition and thus increase the rate of gelation.

In one embodiment of the method of printing or imparting patterning to textile material in which lateral ink spread on the textile material is reduced, the first aqueous composition contains a dye and the second aqueous composition contains a dye modifying agent.

In another embodiment of the method of printing or imparting patterning to textile material in which lateral ink spread is reduced, the gel agent in the gelling agent composition is an algin incompatible cationic dye which dye serves as both a gel agent and a dye for the purposes of this invention.

In the practice of this invention, alginic acid or any suitable derivative of alginic acid can be employed in the gelable composition.

Suitable for use as alginic acid derivatives are the refined sodium alginates designated "KELGIN," the industrial sodium alginates designated "KELTEX," the specially clarified low-calcium sodium alginates designated "KELCO," the refined ammonium and refined potassium alginates designated "SUPERLOID" and "KELMAR," respectively, all commercially available from the Kelco Division of Merck & Co., Inc.

Particularly suitable alginic acid derivatives are the refined sodium alginates designated "KELGIN HV," "KELGIN MV," "KELGIN F," "KELGIN LV," "KELGIN XL," "KELGIN RL," and "KELVIS."

The gelable composition will contain from about 0.5% to about 5% by weight of alginic acid or alginic acid derivative, preferably from about 1% to about 2.5% by weight. The balance of the composition will generally be demineralized water. However, if desired, the gelable composition can also include art recognized amounts of algin compatible dyes, surfactants, foaming or antifoaming agents, thickening agents, dye modifying agents, and the like.

The gelling agent composition will contain a "gel agent" understood to mean a material which serves to change the rheology, viscosity, and thus gel algin polymers. Suitable gel agents include polyvalent cations (not including magnesium) and borate ions which can be employed in the form of polyvalent metal salts and sodium borate, respectively. Also suitable for use as gel agents are cationic dyes which are incompatible with algins, for example, Basic Yellow 53 and 58, Basic Red 22 and 51, Basic Blue 87 and Basic Orange 31.

A particularly suitable polyvalent metal salt for reaction with and gelation of sodium alginate is calcium chloride.

The amount of gel agent employed in the gelling agent composition must be sufficient to gel the gelable composition. The amount of gel agent needed is dependent on the weight of algin in the gelable composition and can be easily calculated. One method of ensuring sufficient gel agent is to employ the gel agent in excess. Generally, employing the gel agent in an amount of at least 5 percent by weight of the gelling agent composition will provide a sufficient amount of cations to ensure gelling. For example, it is known in the art that stoichometrically 7.2% calcium is required based on the weight of sodium alginate for complete substitution but that gels are formed with about 30% of this amount. Further information regarding gel agents and the amounts needed to form algin gels is set forth in the book entitled "Kelco Algin," 2ed. available from the Kelco Division of Merck & Co., Inc. herein incorporated by reference. If a sodium alginate/calcium chloride salt gelling solution is selected, the calcium chloride salt will be present in the gelling agent composition in an amount of from about 1 to about 10 percent by weight of the gelling agent composition. The balance of the composition will generally comprise water. However, if desired, the gelling agent composition can also include art recognized amounts of conventional dyes, surfactants, foaming or antifoaming agents, thickening agents, dye modifying agents, and the like.

Any suitable method can be employed to remove the gel from the textile material. For example, the gel can be removed by use of a high velocity fluid impingement means such as high velocity washers which break up and wash the gel from the textile material. Another suitable method for removing the gel is to wash the textile material with a gel liquifying solution such as a 1 to 2 percent by weight sodium hexametaphosphate in water solution. Other suitable gel liquifying agents include tetrasodium pyrophosphate, a sodium salt of ethylenediamine tetraacetic acid, trisodium phosphate, soda ash, sodium hydroxide, and the like.

The gelable and gelling agent compositions employed in this invention are prepared by conventional methods such as mixing the materials at room temperature with stirring. The compositions can be separately applied to any fiber-type textile in any form. The compositions are applied by conventional textile or carpet printing or dyeing methods such as flat or rotary screen printing, block or raised relief printing, jet printing, stencil printing, engraved cylinder printing, Tak dyeing, Kuster dyeing, beck dyeing, dip squeeze application, hand application, and the like. If applied to pile fabric, such as pile carpeting, both compositions will be applied in amounts and at viscosities to facilitate penetration of at least the tip portion of the face fibers, that is, at least about one-tenth (1/10) of the tuft height down to the base of the pile.

One skilled in the pile fabric art will readily recognize from the following examples that the following criteria—viscosity of the gelable composition, viscosity of the gelling agent composition, percent pickup of the compositions, methods of application, pile fabric construction, etc.—can be separately or collectively chosen to provide the desired amount of pile penetration, within the range of from about onetenth of the tuft height down to the base of the pile, of the gelable and gelling agent compositions, which amount of penetration facilitates the production of pile fabric possessing various decorative patterned effects.

The best mode for carrying out the invention is demonstrated by the following examples.

EXAMPLE I

A portion of the surface of a piece of undyed carpeting (nylon 6 yarn, 40 oz./sq. yd. pile weight, 13/16" pile height, 3/16" gauge, cut pile construction) was conventionally flat screen printed with a design using a gelable composition prepared by mixing, at room temperature, about 3 percent by weight of a sodium alginate, designated "XRD Sodium Alginate," purchased from Marine Colloids Co., and about 97 percent by weight demineralized water. The gelable composition was tested using a Brookfield viscometer, Model RVF, and found to have a viscosity of about 2,080 cp. (No. 2 spindle, 20 rpm). Hereinafter, all viscosities listed will be understood to have been tested using a Model RVF Brookfield viscometer (No. 2 spindle, 20 rpm).

After printing, the carpeting was immersed, for about 30 seconds, in a gelling agent composition prepared by mixing at room temperature about 5 percent by weight calcium chloride and about 95 percent by weight tap water. The carpeting, which now had gelled areas corresponding to the above printed design, was conventionally water washed and dried.

The dried carpeting was then beck-dyed at the boil by immersing the carpeting in an aqueous dye bath containing Acid Blue 40 dye for a sufficient period of time to yield a dye pickup of about 0.25 percent by weight, based on the total weight of the fiber.

The dyed carpeting was then washed with water, followed by washing with a gel liquifying solution prepared by mixing about 2 percent by weight sodium hexametaphosphate and 98 percent by weight tap water.

The resulting carpeting containing the dissolved gel was again washed with tap water to remove the liquified gel, dried, and recovered as dyed pile fabric according to this invention.

The dyed carpeting was observed to be white (not dyed) in the design areas corresponding to the screen printing of the gelable composition and dark blue in all areas which were not screen printed with the gelable composition.

EXAMPLE II

Using a different piece of the same carpeting used in Example I and using substantially the same procedures as Example I, a second piece of dyed carpeting was prepared. However, in this example, the gelable composition included a dye and was prepared by mixing at room temperature about 0.7 percent by weight dye (Resolin Yellow PGG), about 3 percent by weight "XRD Sodium Alginate" and about 96.3 percent by weight demineralized water. The gelable composition had a viscosity of 2,080 cp.

The resulting dyed carpeting was observed to be yellow in the design areas corresponding to the screen printing of the gelable composition and dark blue in all areas which were not screen printed with the gelable composition.

EXAMPLE III

A portion of the surface of a piece of undyed carpeting (nylon 6 yarn, 32 oz./sq. yd. pile weight, ¾" cut pile height, ⅜" loop pile height, 3/16" gauge, cut and loop pile construction) was conventionally screen printed with a design using a first gelable composition containing about 3 percent by weight "XRD Sodium Alginate" and about 97 percent by weight demineralized water. The first gelable composition had a viscosity of 2,080 cp.

Another portion of the surface of the carpeting was screen printed with a design using a second gelable composition containing about 0.5 percent by weight dye (Merpacyl Brilliant Orange Y, commercially available from DuPont), about 3 percent by weight "XRD Sodium Alginate," and about 96.5 percent by weight demineralized water. The second gelable composition had a viscosity of 2,080 cp.

After printing, the carpeting was steamed for about 10 minutes at a temperature of about 212° F., using a conventional horizontal steamer, and then immersed in a gelling agent composition containing 5 percent by weight calcium chloride and 95 percent by weight tap water for a period of about 30 seconds.

The resulting carpeting, which now had gelled areas corresponding to the above printed designs, was conventionally water washed and dried.

The dried carpeting was then over-dyed with a dark brown acid/disperse dye liquor using a Kuster dye applicator to yield a dye liquor pickup of about 430 percent by weight based on the total weight of the carpeting.

The dyed carpeting was steamed at a temperature of about 212° F. for a period of about 8 minutes using a vertical steamer.

After steaming, the carpeting was washed at a wash temperature of about 110° F. with a gel liquifying solution containing 1 percent by weight tetrasodium pyrophosphate and 99 percent by weight tap water.

The carpeting was then washed with water, dried, and recovered as dyed pile fabric.

The dyed carpeting was observed to be white (not dyed) and orange in the design areas corresponding to the first and second screen printings, respectively, and dark brown in all areas which were not screen printed with either gelable composition.

EXAMPLE IV

A piece of undyed carpeting (nylon 6 yarn, 21.5 oz./sq. yd. pile weight, 11/16" cut pile height, 11/32" loop pile height, 3/16" gauge, cut and loop pile construction) was wetted out and squeezed to yield a gelling agent composition pickup of about 75 percent by weight based on the total weight of the carpeting using a gelling agent composition prepared by mixing at room temperature about 5 percent by weight calcium chloride, 0.2 percent by weight foaming agent ("Dianol SWN," commercially available from Quaker Chemical), and about 94.8 percent by weight tap water.

Next, the carpeting was over-dyed with the following gelable composition using a Kuster dye applicator to yield a composition pickup of about 300 percent by weight based on the total carpet weight.

| Material | Amount (Percent by Weight) |
|---|---|
| "KELGIN MV" | 0.6 |
| "KELGIN RL" | 1.8 |
| antifoam agent (2-ethylhexanol) | 1.0 |
| dye (light orange acid dye composition) | 0.3 |
| demineralized water | balance |

The above gelable composition had a viscosity of about 173 cp.

The carpeting was then water washed, dried, and observed. The carpeting was found to have an overall gelled surface which penetrated about the top ¼ or about ¼" of the pile height of the cut pile face fibers.

The dried carpeting was Kuster dyed with a dark brown aqueous acid dye bath to yield a dye pickup of about 500 percent by weight based on the total weight of the carpeting.

The dyed carpeting was then steamed at a temperature of about 212° F. for a period of about 8 minutes using a vertical steamer.

The cut pile tufts of dyed carpeting were observed; each tuft was found to have a light orange tip. The remainder of each tuft was dark brown.

EXAMPLE V

A piece of undyed carpeting (nylon 6 yarn, 31.5 oz./sq. yd. pile weight, ¾" cut pile height, ⅜" loop pile height, 3/16" gauge, cut and loop pile construction) was loaded into a dye beck and completely wetted out with a gelling agent composition containing about 5 percent by weight calcium chloride and 95 percent by weight tap water.

A first gelable composition and a second gelable composition were separately spray applied to the wetted out carpeting while it was rotating in the dye beck. The first gelable composition contained about 2 percent by weight "KELGIN RL" and about 98 percent by weight demineralized water. The second gelable composition contained about 0.5 percent by weight dye, "Merpacyl Orange Y," about 2 percent by weight "KELGIN RL," and about 97.5 percent by weight demineralized water. The viscosity of both gelable compositions was about 30 cp.

After the spray application of the gelable composition was completed, the carpeting was allowed to rotate for about 5 minutes in the gelling agent composition. The dye Beck tank was drained and the carpeting was observed to have excellent patterned design detail corresponding to the spray applications of the gelable composition.

Next the dye beck tank was recharged with a dark brown aqueous acid/disperse dyebath, and the carpeting was rotated in the dyebath at room temperature for about 10 minutes, and then the dyebath was heated at the rate of 3° F./minute, to a temperature of 180° F.

After rotating the carpeting in the dyebath for about 30 minutes at 180° F., the dyebath was drained from the dye beck and the carpeting was rinsed with water.

The dyed carpeting was then washed with a warm (110° F.) gel liquifying composition containing about 1 percent by weight tetrasodium pyrophosphate and about 99 percent by weight water, to liquify the gelled areas.

After a final water rinse, the carpeting was dried, recovered and observed to have white (not dyed) and light orange blotches corresponding to the spray applications of the first and second gelable compositions, respectively. All areas not sprayed with gelable composition were dark brown.

EXAMPLE VI

Two pieces of undyed carpeting (nylon 6 yarn, 10 oz./sq. yd. pile weight, ⅛" loop pile height, 5/64" gauge, level loop construction) piece A (Control) and piece B (Invention) were separately wetted out. Piece A was wetted out with water and squeezed to yield a pickup of about 75 percent by weight based on the total weight of the carpeting. Piece B was wetted out with a 5 percent by weight calcium chloride in water gelling agent composition and squeezed to yield a pickup of about 75 percent by weight based on the total weight of the carpeting.

Next, both pieces of carpeting were ink jet printed with a gelable composition, prepared by mixing at room temperature about 1 percent by weight "XRD Sodium Alginate," about 0.1 percent by weight Acid Blue 40 dye, and 98.9 percent by weight deionized water, by separately passing under and impinging each piece using the same ink jet which consisted of a hypodermic syringe attached to a pressurized bottle. The gelable ink composition had a viscosity of 67 cp. and was printed in line form on the pieces of carpeting.

Both pieces of carpeting were then horizontally steamed, washed, and dried. Piece A was washed with water, and piece B was washed with a gel liquifying solution containing 1 percent by weight tetrasodium pyrophosphate in water followed by a water wash.

Both pieces of carpeting were observed and found to exhibit dye penetration through to their backings. Piece B was observed to exhibit a much greater printed color intensity than piece A.

Both pieces of dried carpeting were tested for lateral ink spread by averaging several width measurements (about 6) of the lines printed in the direction of the tufting rows (TR) and about 6 width measurements of the lines printed across the direction of the tufting rows (ATR) with the following results:

| | Piece | |
|---|---|---|
| Direction of Print | A (Control) | B (Invention) |
| TR | 10/64" | 7/64" |
| ATR | 9/64" | 6/64" |

The above data indicate the effectiveness of this invention in reducing lateral ink spread or migration resulting from the jet printing of textiles.

EXAMPLE VII

Two 9"×18" pieces, of undyed carpeting (nylon 6 yarn, 10 oz./sq. yd. pile weight, ⅛" loop pile height, 5/64" gauge, level loop construction), piece C (Control) and piece D (Invention), were simultaneously screen printed (2 passes using the same screen) with a gelable composition containing about 2 percent by weight "KELGIN RL," about 0.1 percent "Merpacyl Red G," and about 97.9 percent by weight demineralized water using a conventional Zimmer flat bed printer. The gelable ink composition had a viscosity of 2,500 cp.

Next, piece D was overall coated by hand spraying a 5% by weight calcium chloride in water gelling agent composition. Both pieces of carpeting were then vertically steamed, washed, and dried. Piece C was washed with water, and piece D was washed with a gel liquifying solution containing 1 percent by weight tetrasodium pyrophosphate in water followed by a water wash.

The pieces of carpeting were observed and both found to exhibit dye penetration through to the in backings. Piece D was found to exhibit a greater printed color intensity than piece C.

Both pieces of dried carpeting were tested for lateral ink spread or ink migration by taking several measurements (about 6) of the width of lines printed in the direction of the tufting rows through a screen line width opening of 7/64" with the following averaged results:

| Carpeting | Printed Line Width |
|---|---|
| Piece C (Control) | 14/64" |
| Piece D (Invention) | 11/64" |

EXAMPLE VIII

Using the same type carpeting and substantially the same procedure of Example VII, with the exception that horizontal steaming was employed and the pieces of carpeting were subjected to 12 passes using the same screen, two pieces, piece E (Control) and piece F (Invention), were flat bed printed using a Zimmer printer with the following averaged results:

| Carpeting | Printed Line Width |
|---|---|
| Piece E (Control) | 16/64" |
| Piece F (Invention) | 12/64" |

The above data indicate the effectiveness of this invention in inhibiting lateral ink spread or migration resulting from textile printing.

EXAMPLE IX

This example demonstrates a coloration method of this invention which employs a dye modifying agent and exhibits reduced lateral spreading of the dye modifying agent and, accordingly, provides excellent print definition on the textile material.

A piece of undyed woven cloth fabric is jet printed a first time with the gelable composition of Example VIII to form a first printed design thereon.

The fabric is then, while still wet, jet printed a second time with a gelling agent composition containing about 5 percent by weight calcium chloride, about 5 percent by weight displacement chemical ("Alkanol NRT"), and about 90 percent by weight water, to form a second printed design which overlaps portions of the first printed design.

The fabric is then vertically steamed, washed using high velocity washers in order to break up and remove the gel formed in the overlap portions, dried and recovered.

The printed fabric is observed to be red where it was impinged by jet printing with only the gelable composition, to be clear or white where it was impinged by jet printing with only the gelling agent composition and to be light or pale red in the overlap portions corresponding to jet impingment with both the gelable and the gelling agent composition. All printed regions will exhibit excellent print definition.

EXAMPLE X

This example demonstrates a coloration method of this invention which employs an algin incompatible cationic dye which dye serves as a dye for the textile material and also as a gelling agent for the gelable composition.

To a piece of undyed carpeting (e.g., DuPont 744 Nylon 66 Yarn) is overall spray applied a gelable composition containing about 2 percent by weight "KELGIN RL" and about 98 percent by weight demineralized water.

Next, a portion of the surface of the resulting carpeting is jet printed with a design, using a gelling agent composition containing about 2 percent by weight of an algin incompatible cationic dye (Basic Blue 87) and about 98 percent by weight water. The regions of the carpeting which are impinged by jet printing become gelled regions which are blue due to the use of the blue algin incompatible cationic dye gel agent.

The resulting carpeting having gelled regions thereon is then steamed to set the blue dye, washed using high velocity washers in order to physically break up and wash the gel from the carpeting, dried and recovered.

The carpeting is observed to be blue in the regions jet printed with the gelling agent composition and to be clear or white in the regions not jet printed with the gelling agent composition. The blue jet printed regions will exhibit excellent print definition.

What is claimed is:

1. A coloration method for textiles, which method comprises:

(a) applying to at least a portion of the surface of a textile material a first aqueous composition;

(b) applying over at least a portion of said first aqueous composition a second aqueous composition, one aqueous composition being a chemically gelable composition containing alginic acid or an alginic acid derivative, the other aqueous composition being a gelling agent for the gellable composition; whereby the first and the second aqueous compositions undergo chemical reaction and gel in the regions in which they are in contact, forming gelled regions on the textile material, which gelled regions are thermally irreversible within the temperature range of from ambient temperature up to about 300° F. and water insoluble;

(c) dyeing the resulting textile material, the gelled regions serving as dye resist regions;

(d) fixing the dye on the textile material, during which fixing operation the gelled regions remain gelled; and (e) removing the gel from the textile material.

2. The method of claim 1 in which said first aqueous composition is the gelable composition and said second aqueous composition is the gelling agent for the gelable composition.

3. The method of claim 1 in which said first aqueous composition is the gelling agent for the gelable composition and said second aqueous composition is the gelable composition.

4. The method of claim 2 or 3 in which said gelable composition contains sodium alginate and said gelling agent is calcium chloride.

5. The method of claim 1 in which said first aqueous composition, said second aqueous composition or both said compositions contain a dye.

6. A method of printing or imparting patterning to textile material in which lateral ink spread is reduced, which comprises:

(a) applying to at least a portion of the surface of a textile material a first aqueous composition;

(b) applying over at least a portion of said first aqueous composition a second aqueous composition, one aqueous composition being a chemically gelable composition containing alginic acid or alginic acid derivative, the other aqueous composition being a gelling agent for the gelable composition, at least one of said gelable composition or said gelling agent composition containing a dye; whereby the first and the second aqueous compositions undergo chemical reaction and gel in the regions in which they are in contact, forming gelled print or pattern regions on the textile material, which gelled regions are thermally irreversible within the temperature range of from ambient temperature up to about 300° F. and water insoluble;

(c) fixing the dye contained in said at least one of the compositions on the textile material, during which fixing operation the gelled regions remain gelled; and (d) removing the gel from the textile material.

7. The method of claim 6 in which said first aqueous composition is the gelable composition and said second aqueous composition is the gelling agent for the gelable composition.

8. The method of claim 6 in which said first aqueous composition is the gelling agent for the gelable composition and said second aqueous composition is the gelable composition.

9. The method of claim 7 or 8 in which said gelable composition contains sodium alginate and said gelling agent is calcium chloride.

10. The method of claim 6 in which said gelling agent composition contains an algin incompatible cationic dye which serves as the gelling agent for the gelable composition.

11. The method of claim 6 in which said first aqueous composition contains a dye and said second aqueous composition contains a dye modifying agent.

* * * * *